United States Patent [19]

Hochstein

[11] Patent Number: 4,544,988

[45] Date of Patent: Oct. 1, 1985

[54] BISTABLE SHAPE MEMORY EFFECT THERMAL TRANSDUCERS

[75] Inventor: Peter A. Hochstein, Troy, Mich.

[73] Assignee: Armada Corporation, Detroit, Mich.

[21] Appl. No.: 545,789

[22] Filed: Oct. 27, 1983

[51] Int. Cl.[4] ..... H01H 47/26

[52] U.S. Cl. ..... 361/211; 337/140

[58] Field of Search ..... 361/211; 337/140

[56] References Cited

U.S. PATENT DOCUMENTS 3,652,969 3/1972 Willson et al. ..... 337/140
3,893,055 7/1975 Jost et al. ..... 337/140

FOREIGN PATENT DOCUMENTS 281673 12/1913 Fed. Rep. of Germany ..... 337/140
83387 12/1919 Switzerland ..... 337/140

*Primary Examiner*—Reinhard J. Eisenzopf
*Attorney, Agent, or Firm*—Harold W. Milton, Jr.

[57] ABSTRACT

An electrothermal actuator assembly including a primary or armature member movable between first and second positions and biased to remain in either the first and second position to which it is moved with wires each made of shape memory material attached to the primary or armature member and acting in opposition to one another but, alternatively, when electrical current is passed through the respective wires to increase their temperature whereby they shorten in length to move the primary or armature. A switch supplies electrical current selectively through contacts interconnected by the primary or armature member, but only to one wire at a time for moving the armature from one position to another. The armature or primary member may move rectilinearly between first and second positions or may be rotatably supported for movement between first and second positions. The armature or primary member may also interconnect a set of load contacts to supply power to a load in one of the positions.

10 Claims, 7 Drawing Figures

BISTABLE SHAPE MEMORY EFFECT THERMAL TRANSDUCERS

TECHNICAL FIELD

The subject invention relates to an electrothermal transducer or actuator assembly and, more specifically, to an actuator assembly including shape memory material which returns to a predetermined shape when subjected to heat sufficiently to be raised above a transition temperature and which may be elongated when at a lower temperature below the transition temperature.

BACKGROUND OF THE INVENTION

Shape memory effect materials such as Nitinol (NiTi), or copper-zinc-aluminum brasses have been proposed for use in transducers such as actuators and relays. Simple electrothermal relays are known wherein a wire of Nitinol pulls a set of electrical contacts into engagement. Such devices have not been commercialized because of severe problems of element creep, power consumption, cycling rate due to cooling time and/or reliability because of tendencies to burn out.

A simple transducer known to the prior art is one wherein a length of shape memory wire, such as Nitinol, is disposed in series with a spring between a support means and a member to be actuated with a circuit for supplying electrical current through the Nitinol wire whereby the resistance of the wire causes the Nitinol wire to heat above its austenite finish temperature (i.e., transition temperature) so that the wire shortens in length and returns to its memory shape causing the movable end of the wire to move the armature or primary member to a selected position. Heat is removed from the wire by the termination of electrical current therethrough and cooling to ambient temperature at a rate depending upon the temperature difference between the heated wire and ambient. Other factors determining the rate of cooling of the wire include specific heat of the material of which the wire is made, mass and surface area, fluid convection, latent heat of transition, thermal conductivity and diffusivity.

An important limiting aspect of such a simple actuator is that when the electrical current through the shape memory element or wire is interrupted and then the wire cools by conduction, convection and/or radiation to the surrounding environment and the martensitic start temperature is reached, the shape memory element or wire becomes weaker and superplastic. The return spring then overcomes the internal resisting stress in the shape memory element or wire and returns it to the initial position. In other words, the removal of the actuating current which provides heat to the actuating wire simply allows the element to cool and the return motion or lengthening of the wire is a result of the spring in series with the wire.

A drawback of such a combination of elements is that the movable end of the transducer exerts a known force upon the primary or armature member being moved only when the shape memory element is energized or heated above its transition temperature. As the shape memory element cools, the movable end returns to its initial position rather slowly. In other words, the spring in series with the shape memory element applies a continuous force or stress to the element. Consequently, if the return spring strains the shape memory element before it is fully cooled, parts of the element may be plastically deformed and cold worked leading to eventual failure.

SUMMARY OF THE INVENTION

An electrothermal actuator assembly including a primary means supported by a support means for movement between first and second positions. A first temperature-sensitive element made of material which exhibits shape memory due to thermoelastic, martensitic phase transformation extends between the support means and the primary means and is responsive to an increase in temperature above a predetermined transition temperature for reacting between the primary means and the support means to move the primary means from the first position to the second position. The assembly is characterized by a second temperature-sensitive element made of material which exhibits shape memory due to thermoelastic, martensitic phase transformation extending between the support means and the primary means and being responsive to an increase in temperature above the transition temperature for reacting between the primary means and the support means to move the primary means to the first position. A circuit means supplies electrical current through the first element a limited time period sufficient to provide the increase in temperature thereof while preventing current flow through the second element to move the primary means to the second position and, alternatively, supplies electrical current through the second element a limited time period sufficient to provide the increase in temperature thereof while preventing current flow through the first element to move the primary means to the first position. The primary means includes biasing means for maintaining the primary means in the first position until the first element is heated sufficiently to move the primary means to the second position and likewise maintains the primary means in the second position until the second element is heated sufficiently to move the primary means to the first position.

DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

A bistable shape memory effect electrothermal transducer constructed in accordance with the invention is illustrated in FIGS. 1, 4, 5, and 6, respectively. Each of these figures disclose an electrothermal actuator assembly supported on a support means such as a board or platform 10.

Figure 3:
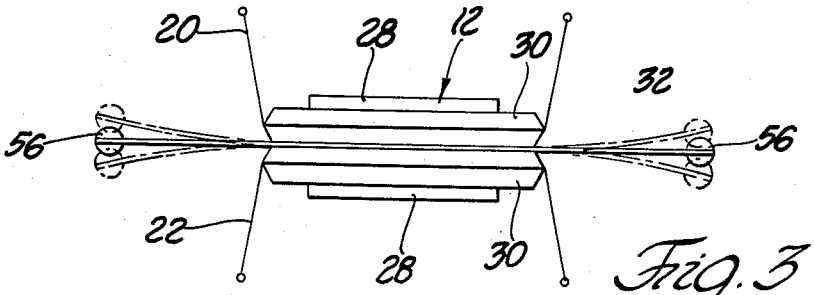
FIG. 3 is an enlarged view showing the primary means or armature of the embodiment of FIG. 1.

Each embodiment includes a primary means supported by the support means 10 for movement between first and second positions. The primary means in FIG. 1 takes the form of an armature or primary member 12, which is more specifically illustrated in FIG. 3, an armature 14 of FIG. 4, an armature 15 of FIG. 5, and an armature 16 of FIG. 6.

Each actuator assembly includes a first temperature-sensitive element made of material which exhibits shape memory due to thermoelastic, martensitic phase transformation extending between the support platform 10 and the primary means. The first temperature-sensitive element comprises a generally U-shaped wire 20 made of shape memory material such as Nitinol. The wire or element 20 is responsive to an increase in temperature to reach a temperature above a predetermined transition temperature for reacting between the armature 12, 14, 15 or 16 and the support 10 to move the armature to the second position as illustrated in phantom in FIGS. 1 and 4.

The assembly also includes a second temperature-sensitive element or wire 22 also made of material such as Nitinol which exhibits shape memory due to thermoelastic, martensitic phase transformation. The second wire or element 22 extends between the support 10 and one of the primaries or armatures 12, 14, 15, or 16. The second element or wire 22 is responsive like the first wire to an increase in temperature to reach a temperature above the transition temperature for reacting between the armature and the support 10 to move the armature back to the first position shown in solid lines in FIGS. 1 and 4.

Each assembly also includes biasing means for maintaining the armature thereof in the first position until the first element 20 is heated sufficiently to move the armature to the second position and for maintaining the armature in the second position until the second element or wire 22 is heated sufficiently to move the primary means or armature back to the first position. Specifically, in the embodiment of FIGS. 1 through 3, the biasing means takes the form of a pair of magnets 24 and 26 which coact with strips 28 made of magnetic material and secured to the armature 12. The armature 12 includes the ferromagnetic strips 28 supported on insulating discs or slabs 30 which, in turn, have sandwiched therebetween a leaf member 32 and portions of the wires 20 and 22. When in the first position illustrated in full lines in FIG. 1, the magnet 24 reacts with the adjacent ferromagnetic strip 28 to retain the armature 12 against the magnet 24 to retain the armature in the first position, but when the wire 22 is heated sufficiently to shorten in length, it will move the armature 12 against the biasing action of the magnet 24 to the second position shown in phantom wherein the magnet 26 will retain the armature 12 in the second position indicated in phantom in FIG. 1. The armature 12 is slidably supported on the support 10 for movement betwen the first position shown in full lines in FIG. 1 and the second position shown in phantom lines in FIG. 1. An appropriate guide rail (not shown in FIG. 1) may interact between the support 10 and the armature 12 for guiding movement of the armature 12 back and forth between the first and second positions.

Figure 4:
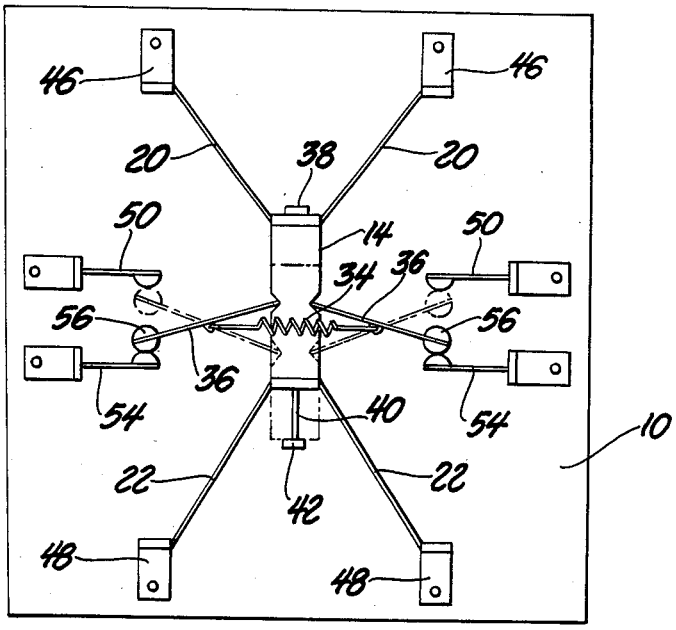
FIG. 4 is a view similar to FIG. 1 showing a second preferred embodiment of the subject invention.

In the embodiment of FIG. 4, the biasing means comprises an over-center spring 34 which coacts with a pair of lever arms 36 having the inner ends disposed in notches in the armature 14 whereby the spring 34 maintains the armature in the first position illustrated in full lines in FIG. 4 against a stop 38. A rail 40 coacts with the armature 14 to rectilinearly guide its movement upon the support 10 between the stops 38 and 42. When the armature 14 moves from the first position to the second position shown in phantom in FIG. 4 against the stop 42, the spring 34 moves over center to the position of the lever arms 36 shown in phantom to retain the armature 14 in the second position.

Figure 5:
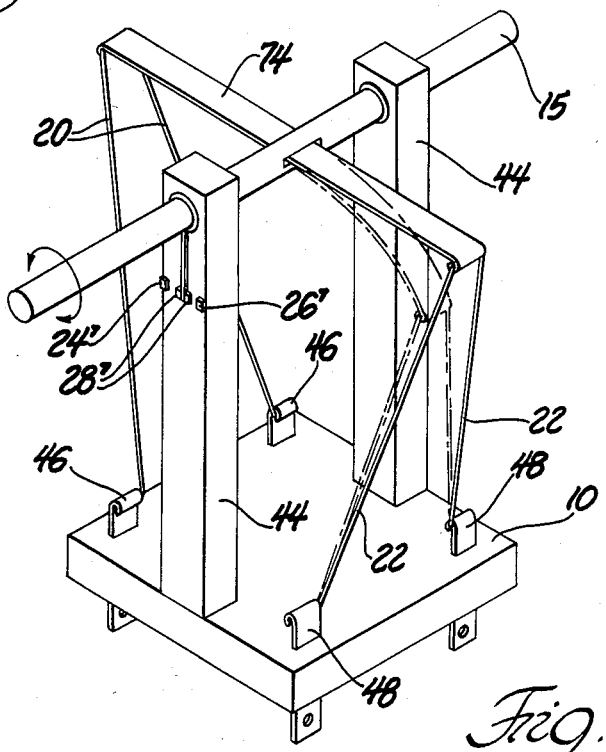
FIG. 5 is a perspective view of yet another embodiment of the subject invention.

In the embodiment of FIG. 5 the armature 15 is rotatably supported in the support posts 44 and has a lever supporting a pair of ferromagnetic plates 28' which react with the spaced magnets 24' and 26' mounted on one of the support posts 44 for biasing the rotary armature 15 into one of the first and second positions.

Figure 6:
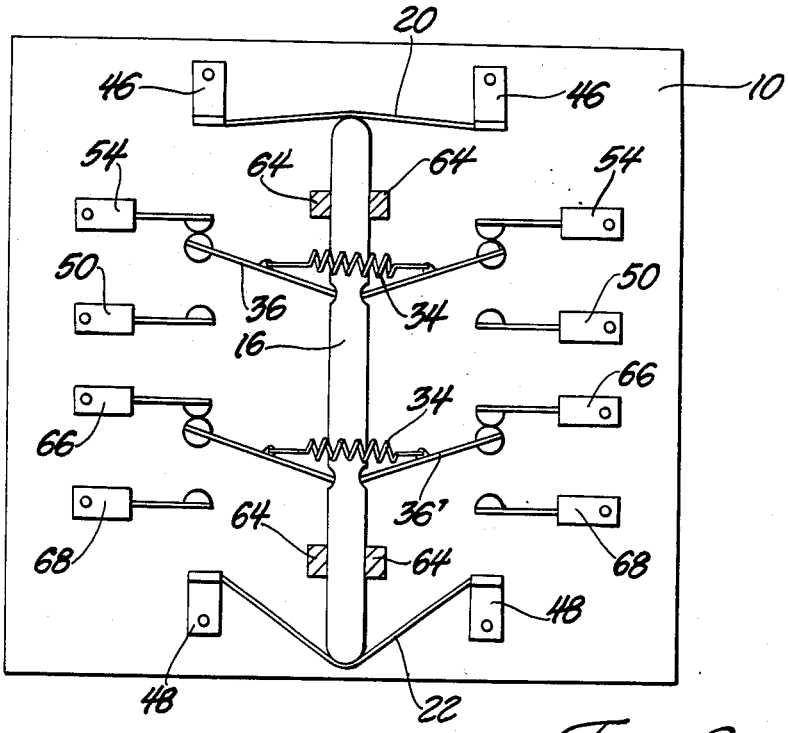
FIG. 6 is a view similar to FIG. 1 but showing yet still another preferred embodiment of the subject invention.

The embodiment of FIG. 6 employs the over-center springs 34 as utilized in the embodiment of FIG. 4.

In each embodiment the first element or wire 20 has two legs which act in parallel in a force-transmitting sense between the armature and the support 10. The wires are attached at the free ends thereof by being attached to electrical connectors 46 which are secured in an electrically insulating manner on the support 10. In a similar fashion, the wires 22 have their free ends attached to electrical connectors 48 mounted upon the support 10.

Figure 2:
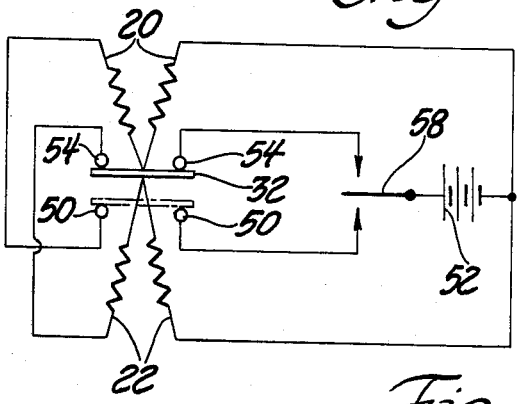
FIG. 2 is an electrical schematic of an electrical circuit employed with the embodiment of FIG. 1.
Figure 7:
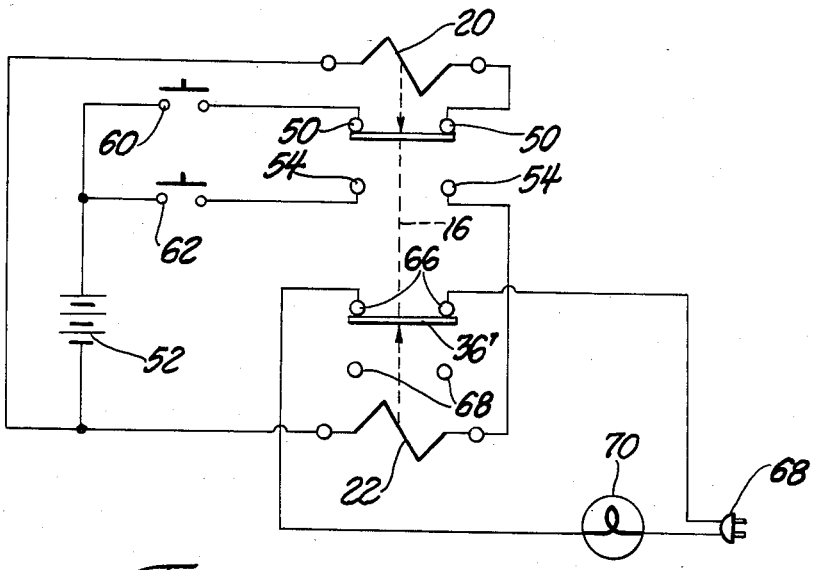
FIG. 7 is an electrical schematic of a circuit which may be employed with the embodiment of FIG. 6.

As illustrated schematically in FIGS. 2 and 7, the assembly includes circuit means for supplying electrical current through the first wire or element 20 a limited time period sufficient to provide the increase in temperature of that wire element 20 while preventing current flow through the second wire element 22 to move the armature 12, 14, 15, or 16 to the second position and for supplying electrical current through the second element or wire 22 a limited time sufficient to provide the increase in temperature of the wire 22 while preventing current flow through the first wire element 20 to move the primary means 12, 14, 15, or 16 to the first position. More specifically, the current means includes a first pair of electrical contacts 50 for establishing electrical current flow from a source of electrical power, such as a battery 52, through the first wire element 20 when electrically interconnected. The circuit means also includes a second pair of electrical contacts 54 for establishing electrical current flow through the second wire element 22 when electrically interconnected. The primary means or actuator 14 includes the lever or beam 32 defining an electrical connection means having contacts 56 on the distal ends thereof for electrically interconnecting the first pair of electrical contacts 50 in the first position and for electrically interconnecting the second pair of contacts 54 when in the second position. The electrical circuit means also includes switch means 58, 60 and 62 for selectively supplying electrical power to the first pair of contacts 50 when the armature 12, 14 or 16 is in the first position for sufficient electrical current to flow through the first wire element 20 to heat the first wire element 20 sufficiently for it to shorten in length and move the primary means or armature 12, 14 or 16 to the second position and to disengage the electrical connection between the first pair of electrical contacts 50 to terminate electrical current flow through the first wire element 20. The switch means also selectively supplies electrical power to the second pair of contacts 54 when the armature 12, 14 or 16 is in the second position for sufficient electrical current flow through the second wire element 22 to heat the second wire element 22 sufficiently for it to shorten in length and move the armature 12, 14, or 16 to the first position and disengage the electrical connection between the second pair of electrical contacts 54 to terminate current flow through the second wire element 22. Consequently, each of the first and second wire elements 20 and 22 respectively receive electrical current flow only until heated sufficiently to undergo a phase transformation and move the armature to which they are attached from one of the first and second positions to the other.

Figure 1:
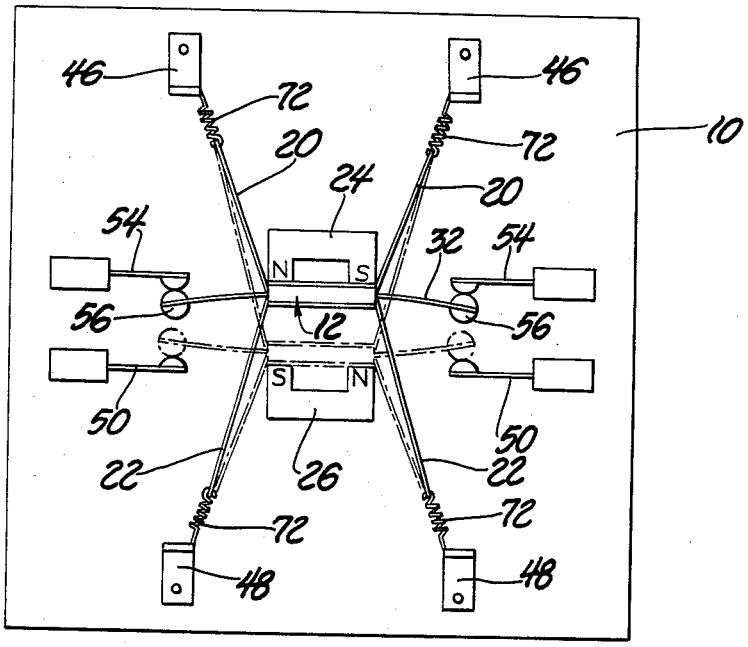
FIG. 1 is a view of a first preferred embodiment of the subject invention.

As the embodiment of FIGS. 1 and 2 illustrates, the armature 12 remains in the first position shown in full lines with the contacts 56 engaging the contacts 50 until the switch 58 is moved upwardly to engage the electrical lead to the contacts 50 whereupon the beam 32 supporting the contacts 56 allows electrical current to flow through the second wire element 22. As alluded to hereinabove, the first second elements 20 and 22 each include two lengths of wire reacting in parallel force-transmitting relationship between the armature to which it is attached and the support 10. Consequently, when electrical current is applied to the second wire element 22, it is heated above its transition temperature and shortens in length with a sufficient force to overcome the biasing action of the magnet 24 to move the armature 12 from the first position shown in full lines in FIG. 1 to the second position shown in phantom lines where it is retained by the action of the magnet 26. During the movement from the first position shown in full lines to the second position shown in phantom in FIG. 1, the contacts 56 disengage the first pair of contacts 50 to discontinue electrical current through the first wire element 20. In other words, once the wire element 20 is heated sufficiently to pass through its transition temperature, it moves its own contacts to disengage further electrical current therethrough. The assembly will remain with the armature 12 in the second position shown in phantom in FIGS. 1 and 2 until the switch 58 is moved so as to energize the contacts 54 to supply electrical current through the second wire element 22 to heat it sufficiently to return the armature 12 to the first position. Thus, the wire elements 20 and 22 extend from the armatures thereof in opposite directions so as to react in opposite directions, i.e., the first and second elements 20 and 22 work alternatively and in opposition to one another. The circuit means assures that only one of the wire elements 20 or 22 is heated above its transition temperature at a time, i.e., electrical current is prevented from heating one shape memory wire element while the other is being heated.

In the embodiment of FIGS. 6 and 7, the rectilinear movement of the armature 16 is guided by guide posts 64 which perform the same function as the rail 40 of the embodiment of FIG. 4. In addition, the embodiment of FIGS. 6 and 7 includes a pair of load contacts 66 for supplying electrical power from a source such as an AC power outlet 68 to a load such as a lamp 70 when electrically interconnected as by the beam 36', the beam 36' defining a load connection means for electrically interconnecting the load contacts 66 when in the first position as illustrated. The embodiment of FIGS. 6 and 7 also includes a pair of inoperative or rest contacts 68 for engaging or contacting the beam 36' when the assembly is in the off position.

When the embodiment of FIGS. 6 and 7 is in the position shown, the switch 60 may be actuated to supply electrical current through the beam 32 between the first set of contacts 50 to supply electrical current through the first wire element 20 which moves the beam 32 from the position illustrated into contact with the contacts 54. The beam 36' is mechanically interconnected with the beam 32 to move therewith as is more evident in FIG. 6 so that it disconnects the load contact 66 thereby turning off the load or lamp 70. Because of the biasing action of the springs 34, the assembly will remain in this position until the button or switch 62 is actuated to supply electrical current between the second set of contacts 54 through the beam 34 to heat the element 22 above its transition temperature to move the beams 32 and 36' upwardly as illustrated in FIG. 7 to again interconnect the contacts 66 and 50.

All of the embodiments may include a stress-limiting means disposed in series with each of the elements 20 and 22 for limiting the strain in each of the elements 20 and 22. Specifically, and as illustrated in FIG. 1, the stress-limiting means may take the form of the helical springs 72 which will expand when the wire elements 20 or 22 are placed under sufficient stress that they would exceed their permissible strain limits. In other words, instead of the wires exceeding their strain limits, the springs 72 have a preselected spring rate whereby they will expand to absorb the force instead of it being applied to the wire elements 20 or 22 to exceed their respective strain limits. A similar stress-limiting means is shown in the embodiment of FIG. 5 wherein the rotary armature 15 is connected to the respective wire elements 20 and 22 by a spring-like leaf member 74 which extends through a slot in the rotating shaft or armature 15 to opposite distal ends which are connected to the wire elements 20 and 22 with the leaf spring member 74 being bendable to absorb the forces which would exceed the permissible strain limits in the wires 20 and 22.

The subject invention, therefore, incorporates a latching or bistable function into an electrothermal shape memory actuator, wherein two separate shaped memory motor elements are connected together and operate in unison. One element actuates the mechanism in one direction while the other motor actuates the mechanism in the opposite direction. The invention is bistable in that when current is not flowing through either element, the output or actuator remains in the last stable position. The contraction or shortening of either element to its recovered shape or length simultaneously strains the opposite element while it is in the martensitic state below its martensitic finish transition temperature. By eliminating the constant return stress of the spring in a simple actuator with a shape memory element in series with the spring, the shape memory alloy is not subject to potentially damaging strain while in the martensitic state. This is because the straining of either element is now controlled only by the energizing of the opposite motor element. In normal use, the time delay between subsequent set and reset actions of such a transducer assembly affords ample time for the cooling below the transition temperature of the element to be strained.

As will be appreciated, the over-center springs or biasing action of the magnets provide contact forces in relays for maintaining the contacts in electrical contact with one another for reliable operation.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property of privilege is claimed are defined as follows:

1. An electrothermal actuator assembly comprising: support means (10); primary means (12, 14, 15, or 16) supported by said support means (10) for movement between first and second positions; a first temperature-sensitive element (20) made of material which exhibits shape memory due to thermoelastic, martensitic phase transformation extending between said support means (20) and said primary means (12, 14, 15, or 16); said first element (20) being responsive to an increase in temperature above a predetermined transition temperature for reacting between said primary means (12, 14, 15, or 16) and said support means (10) to move said primary means (12, 14, 15, or 16) to said second position; characterized by a second temperature-sensitive element (22) made of material which exhibits shape memory due to thermoelastic, martensitic phase transformation extending between said support means (10) and said primary means (12, 14, 15, or 16); said second element (22) being responsive to an increase in temperature above said transition temperature for reacting between said primary means (12, 14, 15, or 16) and said support means (10) to move said primary means (12, 14, 15, or 16) to said first position; and said primary means including biasing means (24, 26, 28, or 24', 26', 28', or 34) for maintaining said primary means (12, 14, 15, or 16) in said first position until said first element (20) is heated sufficiently to move said primary means (12, 14, 15, or 16) to said second position and for maintaining said primary means (12, 14, 15, or 16) in said second position until said second element (22) is heated sufficiently to move said primary means (12, 14, 15, or 16) to said first position, and circuit means for supplying electrical current through said first element (20) a limited time period sufficient to provide said increase in temperature thereof while preventing current flow through said second element (22) to move said primary means (12, 14, 15, or 16) to said second position and for supplying electrical current through said second element (22) a limited time period sufficient to provide said increase in temperature thereof while preventing current flow through said first element (20) to move said primary means to said first position.

2. An assembly as set forth in claim 1 further characterized by said primary means (15) being rotatable between said first and second positions.

3. An assembly as set forth in claim 1 further characterized by said primary means (12, 14, or 16) being linearly movable between said first and second positions.

4. An assembly as set forth in claim 1 further characterized by including a first pair of electrical contacts (50) for establishing electrical current flow through said first element (20) when electrically interconnected and a second pair of electrical contacts (54) for establishing electrical current flow through said second element (22) when electrically interconnected, said primary means (12, 14, or 16) including electrical connection means (32, 56, 36) for electrically interconnecting said first pair of electrical contacts (50) in said first position and electrically interconnecting said second pair of electrical contacts (54) when in said second position.

5. An assembly as set forth in claim 4 further characterized by switch means (58, 60, 62) for selectively supplying electrical power to said first pair of contacts (50) when said primary means (12, 14, 16) is in said first position for sufficient electrical current flow through said first element (20) to heat said first element (20) sufficiently to move said primary means (12, 14, or 16) to said second position and disengage the electrical connection between said first pair of electrical contacts (50) to terminate current flow through said first element (20) and for selectively supplying electrical power to said second pair of contacts (54) when said primary means (12, 14, or 16) is in said second position for sufficient electrical current flow through said second element (22) to heat said second element (22) sufficiently to move said primary means (12, 14, or 16) to said first position and disengage the electrical connection between said second pair of electrical contacts (54) to terminate current flow through said second element (22) so that each of said first and second elements (20, 22) receive electrical current flow only until heated sufficiently to undergo a phase transformation and move said primary means (12, 14, or 16) from one of said positions to the other.

6. An assembly as set forth in claim 5 further characterized by including a pair of load contacts (66) for supplying electrical power from a source to a load (70) when electrically interconnected, said primary means including load connection means (36') for electrically interconnecting said load contacts (66) when in one of said positions.

7. An assembly as set forth in claim 6 further characterized by said switch means including a first switch (60) in series with said first pair of electrical contacts (50) for supplying electrical current to said first element (20) when said primary means (16) is in said first position and a second switch (62) in series with said second pair of electrical contacts (54) for supplying electrical current to said second element (22) when said primary means (16) is in said second position.

8. An assembly as set forth in claim 7 further characterized by said first and second elements (20, 22) each including two lengths of wire reacting in parallel force-transmitting relationship between said primary means (12, 14, 15, or 16) and said support means (10).

9. An assembly as set forth in claim 1 further characterized by said first temperature-sensitive element (20) extending between said primary means (12, 14, 15, or 16) and said support means (10) in one force-transmitting direction and said second temperature-sensitive element (22) extending between said primary means (12, 14, 15, or 16) and said support means (10) in the opposite force-transmitting direction so that said first element (20) shortens in length in response to said increase in temperature to extend the length of said second element (22) while moving said primary means (12, 14, 15, or 16) from said first position to said second position and said second element (22) shortens in length in response to said increase in temperature to extend the length of said first element (20) while moving said primary means (12, 14, 15, or 16) from said second position to said first position whereby said first and second elements (20, 22) work alternatively and in opposition to one another.

10. An assembly as set forth in claim 1 further characterized by including stress-limiting means (72, 74) disposed in series with each of said first and second elements (20, 22) for limiting the strain in each of said first and second elements (20, 22).

* * * * *